US011694823B2

(12) United States Patent
Park et al.

(10) Patent No.: US 11,694,823 B2
(45) Date of Patent: Jul. 4, 2023

(54) ETHERNET CABLE

(71) Applicant: LS CABLE & SYSTEM LTD., Anyang-si (KR)

(72) Inventors: Jae Sung Park, Seoul (KR); Sung Hoon Kim, Gumi-si (KR); Woo Kyoung Lee, Suwon-si (KR); Jung Pyo Hong, Gumi-si (KR)

(73) Assignee: LS CABLE & SYSTEM LTD., Anyang-si (KR)

( * ) Notice: Subject to any disclaimer, the term of this patent is extended or adjusted under 35 U.S.C. 154(b) by 46 days.

(21) Appl. No.: 17/432,143

(22) PCT Filed: Dec. 17, 2019

(86) PCT No.: PCT/KR2019/017861
§ 371 (c)(1),
(2) Date: Aug. 19, 2021

(87) PCT Pub. No.: WO2020/171358
PCT Pub. Date: Aug. 27, 2020

(65) Prior Publication Data

US 2022/0157493 A1 May 19, 2022

(30) Foreign Application Priority Data

Feb. 19, 2019 (KR) ..... 10-2019-0019370
Dec. 16, 2019 (KR) ..... 10-2019-0168088

(51) Int. Cl.
*H01B 1/24* (2006.01)
*H01B 11/10* (2006.01)
(Continued)

(52) U.S. Cl.
CPC ..... *H01B 11/10* (2013.01); *H01B 3/421* (2013.01); *H01B 7/24* (2013.01); *H01B 11/1847* (2013.01)

(58) Field of Classification Search
CPC ..... H01B 7/04; H01B 7/08; H01B 7/0867; H01B 7/0823; H01B 7/0838;
(Continued)

(56) References Cited

U.S. PATENT DOCUMENTS 448,604 A * 3/1891 Conner ..... H01B 7/02 174/36
2,958,724 A * 11/1960 Milloit ..... H04B 3/28 174/33
(Continued)

FOREIGN PATENT DOCUMENTS

CN 101002289 A 7/2007
CN 101458979 A 6/2009
(Continued)

OTHER PUBLICATIONS

Chinese Notice of Allowance for related Chinese Application No. 201980089298.9; action dated Jun. 8, 2022; (5 pages).
(Continued)

*Primary Examiner* — William H. Mayo, III
(74) *Attorney, Agent, or Firm* — K&L Gates LLP

(57) ABSTRACT

An Ethernet cable that includes a pair of cores including a single-wire conductor and an insulator covering the single-wire conductor; and an armoring layer entirely covering the pair of cores, wherein the pair of cores are twisted together to have a twist pitch (P1) in a cable length direction satisfying certain characteristics.

13 Claims, 4 Drawing Sheets

(51) Int. Cl.
*H01B 3/42* (2006.01)
*H01B 7/24* (2006.01)
*H01B 11/18* (2006.01)

(58) Field of Classification Search
CPC ..... H01B 7/2825; H01B 9/02; H01B 11/02; H01B 11/002; H01B 11/04; H01B 11/06; H01B 11/08; H01B 11/10; H01B 11/1091; H01B 11/16
USPC ..... 174/110 R, 113 C, 113 R, 117 R, 120 R
See application file for complete search history.

(56) References Cited

U.S. PATENT DOCUMENTS 3,067,569 A * 12/1962 Kelley, Jr. ..... H01B 7/0009 156/271
3,546,357 A * 12/1970 Windeler ..... H01B 13/0228 174/34
4,777,324 A * 10/1988 Lee ..... H01B 7/0009 174/128.1
5,298,680 A * 3/1994 Kenny ..... H01B 11/04 174/34
5,659,152 A * 8/1997 Horie ..... H01B 11/04 174/128.2
6,066,799 A * 5/2000 Nugent ..... H01B 11/16 174/27
6,259,031 B1 * 7/2001 Totland ..... H01B 11/02 174/113 C
11,158,441 B1 * 10/2021 Farkas ..... H01B 11/12
2006/0081388 A1 * 4/2006 Spath ..... H01B 9/006 174/27
2010/0108349 A1 5/2010 Baeck et al.
2018/0075949 A1 3/2018 Cornelison et al.
2019/0355492 A1 * 11/2019 Uegaki ..... H01B 11/12

FOREIGN PATENT DOCUMENTS

CN 204577128 U 8/2015
CN 108780680 A 11/2018
KR 20140027693 A 3/2014
KR 20160097552 A 8/2016
KR 10-2018-0093089 A 8/2018
KR 20190010685 A 1/2019
WO 2008/126991 A1 10/2008
WO 2016/149349 A1 9/2016

OTHER PUBLICATIONS

International Search Report for related International Application No. PCT/KR2019/017861; report dated Aug. 27, 2020; (5 pages).
Written Opinion for related International Application No. PCT/KR2019/017861; report dated Aug. 27, 2020; (3 pages).

* cited by examiner

Fig. 7

| | PLASTIC DEFORMATION RATE(%) | | PLASTIC DEFORMATION DIFFERENCE (%, STRANDED WIRE-SINGLE WIRE) DUE TO TWIST PITCH DIFFERENCE OF CORE (mm, STRANDED WIRE-SINGLE WIRE) | | | | | |
|---|---|---|---|---|---|---|---|---|
| TWIST PITCH OF CORES(mm) | STRANDED WIRE | SINGLE WIRE | 1 mm | 2 mm | 2.2 mm | 3 mm | 4 mm | 5 mm |
| 4 | 11.21 | 13.63 | - | - | - | - | - | - |
| 5 | 8.62 | 10.78 | - | - | - | - | - | - |
| 6 | 7.34 | 8.22 | - | - | - | - | - | - |
| 7 | 7.37 | 8.07 | -0.80 | -0.67 | -0.64 | -0.53 | -0.29 | -0.02 |
| 7.2 | 7.18 | | | | | | | |
| 8 | 7.27 | 8.28 | -0.88 | -0.71 | -0.67 | -0.49 | -0.23 | 0.11 |
| 8.2 | 7.29 | | | | | | | |
| 9 | 7.40 | 8.53 | -0.97 | -0.75 | -0.70 | -0.46 | -0.15 | 0.25 |
| 9.2 | 7.43 | | | | | | | |
| 10 | 7.57 | 8.85 | -1.07 | -0.80 | -0.74 | -0.47 | -0.06 | 0.42 |
| 10.2 | 7.61 | | | | | | | |
| 11 | 7.78 | 9.23 | -1.18 | -0.85 | -0.78 | -0.45 | 0.03 | 0.60 |
| 11.2 | 7.83 | | | | | | | |
| 12 | 8.05 | 9.69 | -1.31 | -0.90 | -0.81 | -0.42 | 0.15 | 0.80 |
| 12.2 | 8.11 | | | | | | | |
| 13 | 8.36 | 10.23 | -1.44 | -0.96 | -0.85 | -0.39 | 0.27 | 1.01 |
| 13.2 | 8.46 | | | | | | | |
| 14 | 8.79 | 10.84 | -1.58 | -1.01 | -0.88 | -0.35 | 0.39 | 1.22 |
| 14.2 | 8.88 | | | | | | | |
| 15 | 9.27 | 11.55 | -1.71 | -1.06 | -0.92 | -0.31 | 0.52 | 1.43 |
| 15.2 | 9.38 | | | | | | | |
| 16 | 9.84 | 12.34 | -1.85 | -1.10 | -0.94 | -0.27 | 0.64 | 1.62 |
| 16.2 | 9.96 | | | | | | | |
| 17 | 10.49 | 13.20 | -1.97 | -1.14 | -0.96 | -0.23 | 0.76 | 1.79 |
| 17.2 | 10.63 | | | | | | | |
| 18 | 11.24 | 14.14 | -2.08 | -1.16 | -0.97 | -0.18 | 0.85 | 1.91 |
| 18.2 | 11.40 | | | | | | | |
| 19 | 12.07 | 15.14 | -2.16 | -1.18 | -0.98 | -0.15 | 0.91 | 1.98 |
| 19.2 | 12.24 | | | | | | | |
| 20 | 12.98 | 16.18 | -2.22 | -1.19 | -0.98 | -0.13 | 0.94 | 1.99 |
| 20.2 | 13.17 | | | | | | | |
| 21 | 13.96 | 17.24 | -2.25 | -1.19 | -0.97 | -0.12 | 0.93 | 1.92 |
| 21.2 | 14.16 | | | | | | | |
| 22 | 14.99 | 18.30 | -2.24 | -1.17 | -0.96 | -0.13 | 0.87 | 1.78 |
| 22.2 | 15.20 | | | | | | | |
| 23 | 16.06 | 19.32 | -2.20 | -1.15 | -0.95 | -0.16 | 0.75 | 1.54 |
| 23.2 | 16.27 | | | | | | | |
| 24 | 17.13 | 20.29 | -2.12 | -1.13 | -0.94 | -0.22 | 0.56 | 1.23 |
| 24.2 | 17.34 | | | | | | | |
| 25 | 18.17 | 21.17 | -2.01 | -1.10 | -0.93 | -0.30 | 0.35 | 0.83 |
| 25.2 | 18.38 | | | | | | | |
| 26 | 19.17 | 21.94 | -1.86 | -1.07 | -0.92 | -0.42 | 0.07 | 0.36 |
| 26.2 | 19.36 | | | | | | | |
| 27 | 20.08 | 22.56 | -1.69 | -1.04 | -0.93 | -0.56 | -0.26 | - |
| 27.2 | 20.24 | | | | | | | |
| 28 | 20.87 | 23.02 | -1.50 | -1.02 | -0.94 | -0.72 | -0.62 | - |
| 28.2 | 21.01 | | | | | | | |
| 29 | 21.52 | 23.30 | -1.30 | -1.005 | -0.97 | -0.90 | - | - |
| 29.2 | 21.63 | | | | | | | |
| 30 | 22.00 | 23.40 | -1.10 | - | - | - | - | - |
| 30.2 | 22.08 | | | | | | | |
| 31 | 22.30 | 23.30 | - | - | - | - | - | - |
| 31.2 | 22.34 | | | | | | | |
| 32 | 22.4 | 23.02 | - | - | - | - | - | - |

REMARKS: PURPLE HIGHLIGHT REPRESENTS SECTION IN WHICH DIFFERENCE IN PLASTIC DEFORMATION RATE BETWEEN STRANDED WIRE AND SINGLE WIRE DOES NOT EXCEED ±1%

ETHERNET CABLE

CROSS-REFERENCE TO RELATED APPLICATIONS

The present application is a National Stage of International Application No. PCT/KR2019/017861 filed on Dec. 17, 2019, which claims the benefit of Korean Patent Application No. 10-2019-0019370, filed on Feb. 19, 2019, and Korean Patent Application No. 10-2019-0168088 filed on Dec. 16, 2019, filed with the Korean Intellectual Property Office, the entire contents of each hereby incorporated by reference.

FIELD

The present disclosure relates to an Ethernet cable. Specifically, the present disclosure relates to an Ethernet cable that is excellent in durability and electrical characteristics due to high flexibility and resistance to vibration and that may be manufactured at low costs.

BACKGROUND

An Ethernet cable is a communication cable. FIG. 1 is a schematic cross-sectional view of an Ethernet cable of the related art. As shown in FIG. 1, the Ethernet cable of the related art includes a pair of cores 10 that includes a conductor 11 and an insulator 12 covering the conductor 11 and are twisted together at a certain pitch, and an armoring layer 20 entirely covering the pair of cores 10.

The Ethernet cable of the related art is required to have high flexibility and be resistant to vibration according to usage and a cable laying environment, and thus, a stranded wire consisting of a plurality of wires twisted together is generally applied as the conductor 11.

Here, when the flexibility of the Ethernet cable does not meet a certain criterion, the pair of cores 10 may be separated from each other when the Ethernet cable is laid in a curved area, thereby degrading electrical characteristics. When the resistance of the Ethernet cable to vibration does not meet a certain criterion, the Ethernet cable may be broken due to vibration and thus a communication function may be degraded or disabled when the Ethernet cable is applied to a mobile means, such as a car, a vessel, a train, or an airplane, or a cable laying environment in which shaking may occur. In this case, safety will be seriously threatened when communication cannot be established with a variety of communication equipment such as a radar device due to the breakage of the Ethernet cable.

However, when a stranded wire is applied as the conductor 11, flexibility and resistance to vibration are improved but processing costs and labor costs are incurred to combine strands, and particularly, to combine strands at a certain pitch, thereby increasing manufacturing costs of the Ethernet cable. When resistance is reduced to satisfy electrical characteristics of a high-specification cable, an outer diameter of the cable may increase unnecessarily.

Accordingly, there is an urgent need for an Ethernet cable that is excellent in flexibility, resistance to vibration, durability, and electrical characteristics and can be manufactured at low costs.

SUMMARY

The present disclosure is directed to providing an Ethernet cable that is excellent in durability due to high flexibility and resistance to vibration.

The present disclosure is also directed to providing an Ethernet cable in which resistance may be reduced due to excellent electrical characteristics without increasing an outer diameter of the cable.

The present disclosure is also directed to providing an Ethernet cable that may be manufactured at low costs.

According to an aspect of the present disclosure, provided is an Ethernet cable comprising: a pair of cores including a single-wire conductor and an insulator covering the single-wire conductor; and an armoring layer entirely covering the pair of cores, wherein the pair of cores are twisted together to have a twist pitch (P1) in a cable length direction, wherein the twist pitch (P1) of the pair of cores satisfies the following Equation 1:

$$2.2\text{ mm} \le P3 = P1 \le 4\text{ mm}, \quad \text{[Equation 1]}$$

wherein P2 represents a twist pitch of a pair of cores of a virtual Ethernet cable including a stranded-wire conductor in which six strands are arranged around a center strand and a twist pitch P3 of the strands are 10 mm, wherein the virtual Ethernet cable is substantially the same as the Ethernet cable in terms of a material of a conductor, a total diameter of a conductor, a material and thickness of an insulator, the number of cores, a material and thickness of an armoring layer, and a plastic deformation rate of a bent portion of the cable when the cable is bent by 180°, except a nominal cross-sectional area of the conductor and the twist pitch of a pair of cores.

According to another aspect of the present disclosure, provided is the Ethernet cable, wherein the plastic deformation rate is measured through a numerical analysis based on a finite element analysis.

According to other aspect of the present disclosure, provided is the Ethernet cable, wherein the plastic deformation rate is measured by the ABAQUS program, which is a numerical analysis program manufactured by Dassault Systemes.

According to other aspect of the present disclosure, provided is the Ethernet cable, wherein the twist pitch (P1) of the pair of cores is in a range of 7 to 28 mm.

According to other aspect of the present disclosure, provided is the Ethernet cable, wherein the plastic deformation rate is in a range of 7 to 25%.

According to other aspect of the present disclosure, provided is the Ethernet cable, wherein the twist pitch (P1) of the pair of cores satisfies the following Equation 2:

$$2.2\text{ mm} \le P2 - P1 \le 3\text{ mm}, \quad \text{[Equation 2]}$$

wherein P2 is as defined in Equation 1 above.

According to other aspect of the present disclosure, provided is the Ethernet cable, wherein a radius of the single-wire conductor is in a range of 0.19 to 0.5 mm and a nominal cross-sectional area thereof is in a range of 0.11 to 0.79 $mm^2$.

According to other aspect of the present disclosure, provided is the Ethernet cable, wherein the insulator comprises a polyolefin-based resin, and the armoring layer comprises polyvinyl chloride resin.

According to other aspect of the present disclosure, provided is the Ethernet cable, wherein the armoring layer comprises a solid armoring layer filling an empty space between the pair of cores.

According to other aspect of the present disclosure, provided is the Ethernet cable, wherein the insulator has a thickness of 0.18 to 1.5 mm, and the Ethernet cable has a total outer diameter of 3 to 6 mm.

According to other aspect of the present disclosure, provided is the Ethernet cable, further comprising: a shielding layer provided between the pair of cores and the armoring layer to cover the pair of cores; and a bedding layer provided to fill an empty space between the pair of cores and the shielding layer.

According to other aspect of the present disclosure, provided is the Ethernet cable, wherein the shielding layer comprises an aluminum tape and a metal braided structure.

According to other aspect of the present disclosure, provided is the Ethernet cable, wherein the aluminum tape comprises an aluminum-mylar tape, and the metal braided structure comprises a tin-plated copper braided structure.

In an Ethernet cable according to the present disclosure, a single-wire conductor is employed and a twist pitch of a pair of cores is precisely controlled to achieve the same flexibility and resistance to vibration as when a single-wire conductor is applied.

In the Ethernet cable according to the present disclosure, a single-wire conductor is employed and a twist pitch of a pair of cores is precisely controlled to achieve excellent electrical characteristics, thereby reducing resistance without increasing an outer diameter of the cable.

Furthermore, in the Ethernet cable according to the present disclosure, a single-wire conductor is employed to reduce processing costs and labor costs incurred to manufacture a stranded-wire conductor, thereby reducing manufacturing costs.

DESCRIPTION OF THE DRAWINGS

FIG. 7 is a table showing the difference in a plastic deformation rate between a stranded-wire conductor and a single-wire conductor according to a twist pitch.

DETAILED DESCRIPTION

Hereinafter, embodiments of the present disclosure will be described in detail with reference to the accompanying drawings. The present disclosure is, however, not limited thereto and may be embodied in many different forms. Rather, the embodiments set forth herein are provided so that this disclosure will be thorough and complete, and fully convey the scope of the disclosure to those of ordinary skill in the art. Throughout the specification, the same reference numbers represent the same elements.

Figure 1:
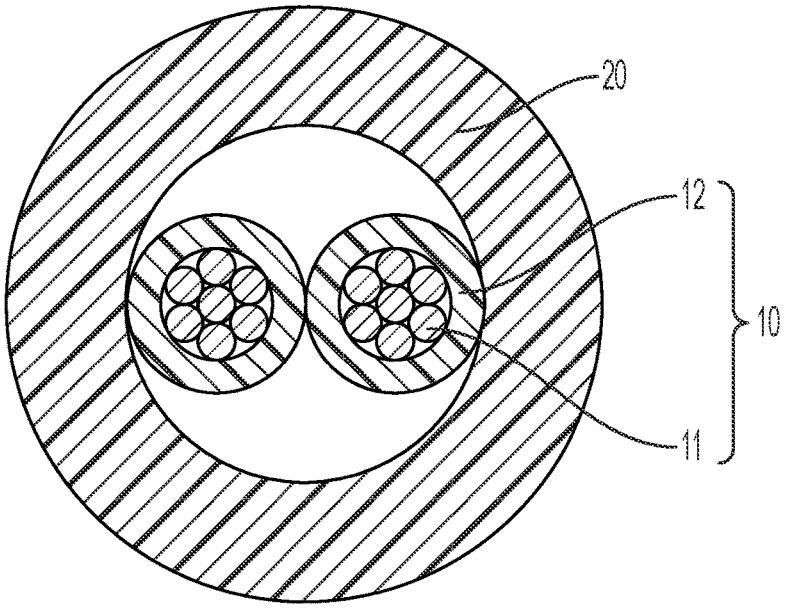
FIG. 1 (Prior Art)
FIG. 1 is a schematic cross-sectional view of an Ethernet cable of the related art.
Figure 2:
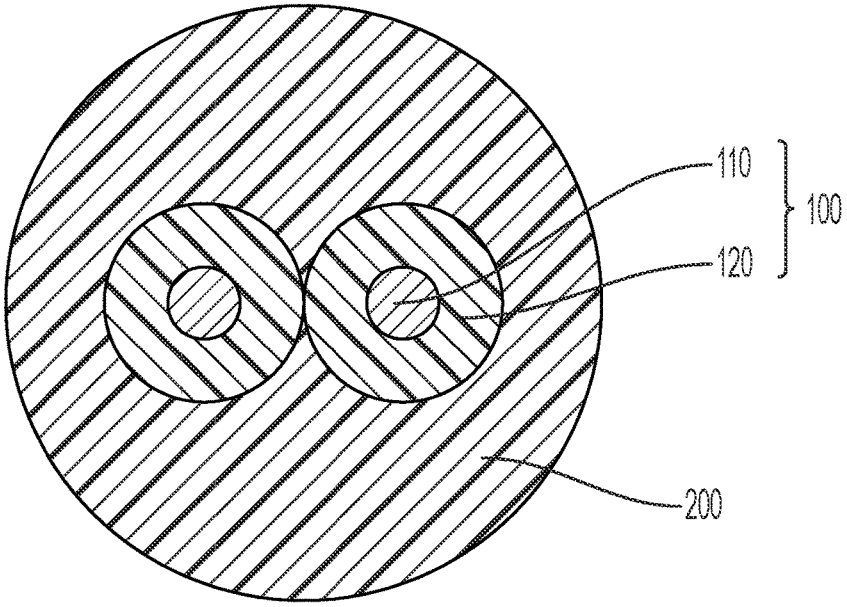
FIG. 2 is a schematic cross-sectional view of an Ethernet cable according to an embodiment of the present disclosure.
Figure 3:
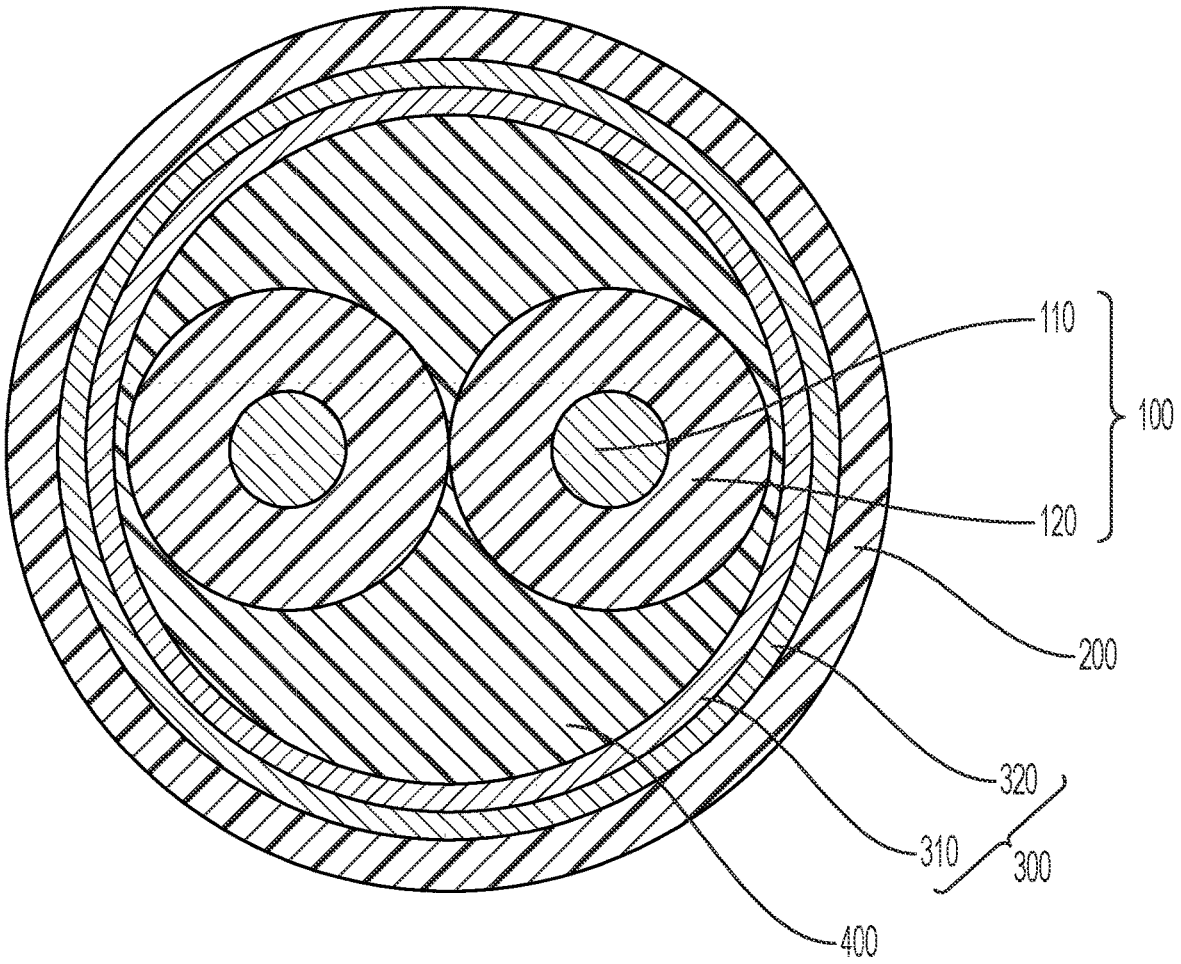
FIG. 3 is a schematic cross-sectional view of an Ethernet cable according to another embodiment of the present disclosure.

FIG. 2 is a schematic cross-sectional view of an Ethernet cable according to an embodiment of the present disclosure. FIG. 3 is a schematic cross-sectional view of an Ethernet cable according to another embodiment of the present disclosure.

As illustrated in FIG. 2, an Ethernet cable according to the present disclosure may include a pair of cores 100, which includes a single-wire conductor 110 and an insulator 120 covering the single-wire conductor 110 and are twisted together at a certain pitch, and an armoring layer 200 entirely covering the pair of cores 100.

As illustrated in FIG. 3, an Ethernet cable according to the present disclosure may further include a shielding layer 300 provided between the pair of cores 100 and the armoring layer 200 to cover the pair of cores 100, and a bedding layer 400 provided to fill an empty space between the pair of cores 100 and the shielding layer 300.

Here, the shielding layer 300 may reflect or absorb and block electromagnetic waves emitted from the pair of cores 100 to the outside or electromagnetic waves emitted from the outside to penetrate the Ethernet cable of the present disclosure, and may include an aluminum tape 310, e.g., an aluminum-mylar tape that is a polyester film attached with aluminum foil, and/or a metal braided structure 320, e.g., a tin-plated copper braided material.

When the shielding layer 300 includes both the aluminum tape 310 and the metal braided structure 320, the pair of cores 100 may be covered with the aluminum tape 310 and the metal braided material 320 may be provided to cover the aluminum tape 310.

An empty space between the pair of cores 100 and the shielding layer 300 may be filled with the bedding layer 400 to improve roundness of the Ethernet cable, structurally stabilize the Ethernet cable, maintain an interval between the pair of cores 100 and the shielding layer 300 constant, and maintain impedance constant according to the internal, thereby improving communication performance, and the bedding layer 400 may be formed of, for example, a resin such as polyvinyl chloride (PVC), polyethylene (PE), cross-linked polyethylene (XLPE), polypropylene (PP), fluorinated ethylene propylene (FEP), or the like.

The single-wire conductor 110 may be formed of a metal material such as copper, aluminum, silver, or an alloy thereof. For example, the single-wire conductor 110 may be formed of a metal material having specific resistance of $1.68\times10^{-8}$ Ω·m, and a radius thereof may be appropriately selected by a technician of ordinary skill in the art according to usage of the cable and may be, for example, in a range of 0.19 to 0.5 mm, and preferably, a range of 0.3 to 0.5 mm. A nominal cross-sectional area may be, for example, 0.11 to 0.79 $mm^2$.

As compared to a stranded-wire conductor including a plurality of strands twisted together at a certain pitch, the single-wire conductor 110 has a larger nominal cross-sectional area at the same outer diameter and thus has low resistance and excellent electrical characteristics and may contribute to saving of processing costs and labor costs incurred to combine strands to form the stranded-wire conductor, thereby reducing manufacturing costs of the cable.

However, the flexibility and resistance to vibration of the single-wire conductor 110 are lower than those of a stranded-wire conductor of the related art, which has the same outer diameter as the single-wire conductor 110, but may be increased by accurately controlling a pitch of the core 100, as will be described below.

The insulator 120 may be formed by extrusion of an insulating composition including a polymer resin having an electrically insulating property as a base resin. The polymer resin is not particularly limited as long as electrical insulating characteristics can be achieved, and may include a polyolefin-based resin such as polyethylene, ethylene vinyl acetate, ethylene ethyl acetate, and ethylene butyl acrylate. A thickness of the insulator 120 may be appropriately selected by a technician of ordinary skill in the art according to a material and a diameter of the conductor 110, a material of the insulator 120, etc. For example, the thickness of the insulator 120 may be in a range of 0.18 to 1.5 mm.

The armoring layer 200 may entirely cover the pair of cores 100 to protect the pair of cores 100 from pressure or impact from the outside. In particular, a solid armoring layer may be applied to fill an empty space between the pair of cores 100 so as to maintain a pitch between the pair of cores 100, which will be described below, when the Ethernet cable is bent, thereby stably maintaining the structure of the pair of cores 100.

The armoring layer 200 may be formed by extrusion of, for example, polyvinyl chloride resin, polyethylene resin, or fluorine resin, and preferably, an armoring layer composition including polyvinyl chloride resin having excellent flexibility as a base resin. A thickness of the armoring layer 200 may be appropriately selected by a technician of ordinary skill in the art in view of a material of the armoring layer 200, a total outer diameter of the cable, the use of the cable, a cable laying environment, or the like, and the total cable outer diameter may be in a range of 3 to 6 mm with respect to the thickness of the armoring layer 200.

In the present disclosure, the pair of cores 100 may be combined at a precisely controlled twist pitch.

Figure 4:
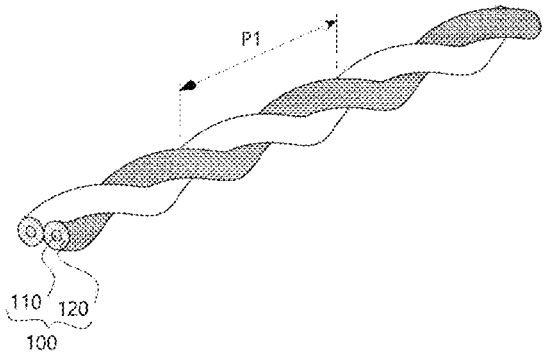
FIG. 4 is a diagram illustrating a twist pitch P1 of a pair of cores when a conductor in Equation 1 below is a single-wire conductor.
Figure 5:
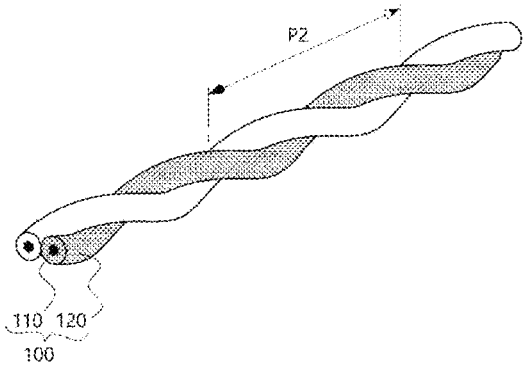
FIG. 5 is a diagram illustrating a twist pitch P2 of a pair of cores when the conductor in Equation 1 below is a stranded-wire conductor.
Figure 6:
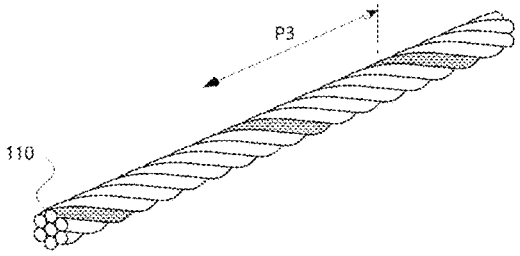
FIG. 6 is a diagram illustrating a twist pitch P3 of a stranded-wire conductor in Equation 1 below.

Specifically, the twist pitch P1 of the pair of cores 100 as shown in FIG. 4 may satisfy Equation 1 below.

$$2.2\text{ mm} \le P2 - P1 \le 4\text{ mm}, \quad \text{[Equation 1]}$$

wherein as shown in FIGS. 5 and 6, P2 represents a twist pitch of a pair of cores of a virtual Ethernet cable including a stranded-wire conductor in which six strands are arranged around a center strand and a twist pitch P3 of the strands are 10 mm, wherein the virtual Ethernet cable is substantially the same as the Ethernet cable in terms of a material of a conductor, a total diameter of the conductor, i.e., a diameter of the conductor when a plurality of strands of a stranded-wire conductor are combined when the conductor is the stranded-wire conductor, a material and thickness of an insulator, the number of cores, a material and thickness of an armoring layer, and a plastic deformation rate of a bent portion of the cable when the cable is bent by 180°, except a nominal cross-sectional area of the conductor and the twist pitch of a pair of cores.

Preferably, the twist pitch P1 of the pair of cores 100 may satisfy Equation 2 below.

$$2.2\text{ mm} \le P2 = P1 \le 3\text{ mm}, \quad \text{[Equation 2]}$$

In Equation 2 above, P2 is the same as in Equation 1 above.

Thus, the plastic deformation rate may be in a range of 7 to 25%.

A bent portion of the cable when bent by 180° due to an external force is deformed. The deformation may include elastic deformation, which means that the bent portion returns to an original state when the external force is removed, and plastic deformation, which means that the bent portion does not return to the original state due to recombination of atoms of a material. A deformation rate due to elastic deformation will be referred to as an elastic deformation rate, and a deformation rate due to plastic deformation will be referred to as a plastic deformation rate. The expression "substantially the same" should be understood to mean that the difference between the Ethernet cable and the virtual Ethernet cable in terms of a plastic deformation rate, etc. is ±1% or less.

The plastic deformation rate may be measured through a numerical analysis based on a finite element analysis (FEA). Specifically, a cable model may be manufactured using a numerical analysis program based on the FEA, e.g., the ABAQUS program (manufacturer: Dassault Systemes) by applying thereto a structure and total diameter of a cable, a material and total diameter of a conductor, a material and thickness of an insulator, a material and thickness of an armoring layer, a nominal cross-sectional area when the conductor is a stranded-wire conductor or a single-wire conductor, a twist pitch of strands or cores, etc., and a plastic deformation rate of a bent portion of the cable model when bent by 180° may be measured.

Furthermore, a plastic deformation rate of each of a cable employing a stranded-wire conductor and a cable employing a single-wire conductor, which are the same in terms of a structure and total diameter of a cable, a material and total diameter of a conductor, a material and thickness of an insulator, and a material and thickness of an armoring layer, according to a twist pitch of a pair of cores may be measured, and the difference in twist pitch between a cable employing the stranded-wire conductor and a cable employing the single-wire conductor, which are substantially same in terms of a plastic deformation rate, may be calculated.

When the Ethernet cable of the present disclosure has the twist pitch of the core described above, resistance is lower than that of an Ethernet cable of the related art, which employs a stranded-wire conductor and has the same outer diameter, and thus excellent electrical characteristics may be achieved and a plastic deformation rate and flexibility and resistance to vibration may be substantially the same as those of the Ethernet cable of the related art.

In the Ethernet cable of the present disclosure, when a twist pitch of the core 100 is extremely short, e.g., less than 7 mm, stress may be applied due to tension caused by a twist pitch of the conductor and thus the same flexibility and resistance to vibration as the Ethernet cable of the related art employing the stranded-wire conductor are difficult to achieve. When a twist pitch of the core 100 is extremely long, e.g., greater than 28 mm, an effect of the twist pitch may not be achieved. When a twist pitch of the pair of cores 100 is in a range of 7 to 28 mm, resistance may be significantly reduced and electrical characteristics may be significantly improved, compared to the Ethernet cable of the related art employing the stranded-wire conductor.

When the difference in twist pitch between a cable employing a stranded-wire conductor and a cable employing a single-wire conductor, which are substantially same in terms of a plastic deformation rate, is less than 2.2 mm or greater than 4 mm, the plastic deformation rate of the cable employing the single-wire conductor is beyond a substantially same range of ±1%, compared to the cable employing the stranded-wire conductor. Accordingly, a desired effect of improving flexibility, durability, and electrical characteristics of the Ethernet cable of the present disclosure may not be achieved.

In fact, as shown in FIG. 7, assuming that a twist pitch of a pair of cores was 7 to 28 mm, the difference in plastic deformation rate between the cable employing the stranded-wire conductor and the cable employing the single-wire conductor was adjusted to be within the substantially same range of ±1% only when the difference in twist pitch between the cable employing the stranded-wire conductor and the cable employing the single-wire conductor was 2.2 to 4 mm.

While the present disclosure has been described above with respect to exemplary embodiments thereof, it would be understood by those of ordinary skilled in the art that various changes and modifications may be made without departing from the technical conception and scope of the present disclosure defined in the following claims. Thus, it is clear that all modifications are included in the technical scope of the present disclosure as long as they include the components as claimed in the claims of the present disclosure.

The invention claimed is:

1. An Ethernet cable comprising:

a pair of cores including a single-wire conductor and an insulator covering the single-wire conductor; and an armoring layer entirely covering the pair of cores, wherein the pair of cores are twisted together to have a twist pitch (P1) in a cable length direction, wherein the twist pitch (P1) of the pair of cores satisfies the following Equation 1:

$$2.2\ \text{mm} \leq P3 = P1 \leq 4\ \text{mm}, \quad \text{[Equation 1]}$$

wherein P2 represents a twist pitch of a pair of cores of a virtual Ethernet cable including a stranded-wire conductor in which six strands are arranged around a center strand and a twist pitch P3 of the strands are 10 mm, wherein the virtual Ethernet cable is substantially the same as the Ethernet cable in terms of a material of a conductor, a total diameter of a conductor, a material and thickness of an insulator, the number of cores, a material and thickness of an armoring layer, and a plastic deformation rate of a bent portion of the cable when the cable is bent by 180°, except a nominal cross-sectional area of the conductor and the twist pitch of a pair of cores.

2. The Ethernet cable of claim 1, wherein the plastic deformation rate is measured through a numerical analysis based on a finite element analysis.

3. The Ethernet cable of claim 2, wherein the plastic deformation rate is measured by the ABAQUS program, which is a numerical analysis program manufactured by Dassault Systems.

4. The Ethernet cable of claim 1, wherein the twist pitch (P1) of the pair of cores is in a range of 7 to 28 mm.

5. The Ethernet cable of claim 1, wherein the plastic deformation rate is in a range of 7 to 25%.

6. The Ethernet cable of claim 1, wherein the twist pitch (P1) of the pair of cores satisfies the following Equation 2:

$$2.2\ \text{mm} \leq P2 - P1 \leq 3\ \text{mm}, \quad \text{[Equation 2]}$$

wherein P2 is as defined in Equation 1 above.

7. The Ethernet cable of claim 1, wherein a radius of the single-wire conductor is in a range of 0.19 to 0.5 mm and a nominal cross-sectional area thereof is in a range of 0.11 to 0.79 $mm^2$.

8. The Ethernet cable of claim 1, wherein the insulator comprises a polyolefin-based resin, and the armoring layer comprises polyvinyl chloride resin.

9. The Ethernet cable of claim 1, wherein the armoring layer comprises a solid armoring layer filling an empty space between the pair of cores.

10. The Ethernet cable of claim 1, wherein the insulator has a thickness of 0.18 to 1.5 mm, and the Ethernet cable has a total outer diameter of 3 to 6 mm.

11. The Ethernet cable of claim 1, further comprising:

a shielding layer provided between the pair of cores and the armoring layer to cover the pair of cores; and a bedding layer provided to fill an empty space between the pair of cores and the shielding layer.

12. The Ethernet cable of claim 11, wherein the shielding layer comprises an aluminum tape and a metal braided structure.

13. The Ethernet cable of claim 12, wherein the aluminum tape comprises an aluminum-mylar tape, and the metal braided structure comprises a tin-plated copper braided structure.

* * * * *